US009009962B2

(12) United States Patent
Sugie et al.

(10) Patent No.: US 9,009,962 B2
(45) Date of Patent: Apr. 21, 2015

(54) METHOD FOR MANUFACTURING CONNECTOR TERMINAL AND CONNECTOR TERMINAL

(75) Inventors: Naoto Sugie, Makinohara (JP); Tomoyuki Miyakawa, Utsunomiya (JP); Kazuto Ohtaka, Makinohara (JP); Hideki Homma, Tokyo (JP); Tetsuya Mitani, Wako (JP); Masaru Shinmura, Wako (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 238 days.

(21) Appl. No.: 13/821,454

(22) PCT Filed: Sep. 9, 2011

(86) PCT No.: PCT/JP2011/071169

§ 371 (c)(1),
(2), (4) Date: Mar. 7, 2013

(87) PCT Pub. No.: WO2012/033231

PCT Pub. Date: Mar. 15, 2012

(65) Prior Publication Data

US 2013/0171890 A1 Jul. 4, 2013

(30) Foreign Application Priority Data

Sep. 10, 2010 (JP) ..... 2010-203387

(51) Int. Cl.

| | |
|---|---|
| ***H01R 43/04*** | (2006.01) |
| ***H01R 11/22*** | (2006.01) |
| ***H01R 43/16*** | (2006.01) |

(Continued)

(52) U.S. Cl.
CPC ..... *H01R 43/16* (2013.01); *H01R 4/185* (2013.01); *H01R 13/03* (2013.01); *H01R 13/115* (2013.01); *H01R 13/33* (2013.01)

(58) Field of Classification Search
USPC ..... 29/874, 870, 882; 439/751, 855
See application file for complete search history.

(56) References Cited

U.S. PATENT DOCUMENTS

| | | | | |
|---|---|---|---|---|
| 3,120,990 | A * | 2/1964 | Kinkald | 439/855 |
| 3,720,907 | A * | 3/1973 | Asick | 439/636 |

(Continued)

FOREIGN PATENT DOCUMENTS

| | | | |
|---|---|---|---|
| CA | 2047502 | C | 5/1995 |
| JP | 2000208231 | A * | 7/2000 |

(Continued)

OTHER PUBLICATIONS

International Search Report dated Nov. 16, 2011 from the International Searching Authority in counterpart application No. PCT/JP2011/071169.

(Continued)

*Primary Examiner* — Carl Arbes
(74) *Attorney, Agent, or Firm* — Sughrue Mion, PLLC

(57) ABSTRACT

In a stamping step, when a stamping terminal piece formed as a connector terminal is stamped, an electric wire crimping part is stamped and extended from a chain part in a direction perpendicular to a feeding direction, an electric contact part is stamped and extended from the electric wire crimping part in a direction parallel to the feeding direction and a range to which a gold plating is applied by a gold plating step is not overlapped on a range to which a tin plating is applied by a tin plating step in the feeding direction.

3 Claims, 5 Drawing Sheets

(51) Int. Cl.

| | |
|---|---|
| ***H01R 13/03*** | (2006.01) |
| ***H01R 13/33*** | (2006.01) |
| *H01R 4/18* | (2006.01) |
| *H01R 13/115* | (2006.01) |

(56) References Cited

U.S. PATENT DOCUMENTS

| | | | | |
|---|---|---|---|---|
| 3,771,111 | A * | 11/1973 | Pritulsky | 439/850 |
| 4,927,788 | A | 5/1990 | Nakashima et al. | |
| 5,067,916 | A | 11/1991 | Denlinger et al. | |
| 5,190,486 | A | 3/1993 | Tsuk | |
| 5,307,562 | A | 5/1994 | Denlinger et al. | |
| 6,283,794 | B1 | 9/2001 | Osuga | |
| 7,344,388 | B2 * | 3/2008 | Kreuter | 439/82 |
| 8,597,062 | B2 * | 12/2013 | Casses et al. | 439/686 |
| 2002/0009924 | A1 | 1/2002 | Little et al. | |
| 2002/0137397 | A1 | 9/2002 | Little | |
| 2006/0172585 | A1 | 8/2006 | Tashiro et al. | |

FOREIGN PATENT DOCUMENTS

| | | | |
|---|---|---|---|
| JP | 2003-217785 | A | 7/2003 |
| JP | 2003527726 | A | 9/2003 |

OTHER PUBLICATIONS

Written Opinion dated Nov. 16, 2011 from the International Searching Authority in counterpart application No. PCT/JP2011/071169.

Office Action dated Oct. 28, 2014 issued by the State Intellectual Property Office of the People's Republic of China in counterpart Chinese Patent Application No. 2011880043703.7.

* cited by examiner

METHOD FOR MANUFACTURING CONNECTOR TERMINAL AND CONNECTOR TERMINAL

TECHNICAL FIELD

The present invention relates to a method for manufacturing a connector terminal which is used when an electronic circuit or various kinds of electronic devices are electrically connected and a connector terminal, and more particularly relates to a method for manufacturing a connector terminal bent substantially at right angles like the shape of L and a connector terminal.

BACKGROUND ART

FIGS. 4(*a*) and (*b*) are perspective views showing one example of a usual connector terminal. FIG. 5 is a plan view of a base material used for the usual connector terminal. The connector terminal 1 shown in FIG. 4(*a*) is manufactured by stamping and bending the base material (an electrically conductive metal plate). A tubular electric contact part 11 is formed in a front side of the connector terminal 1 in a longitudinal direction thereof. A U shaped electric wire crimping part 12 having a bottom plate 12*a* and a pair of grip pieces 12*b* and 12*b* standing from the bottom plate 12*a* is formed at a rear side of the connector terminal 1. A coated electric wire is crimped by and connected to the electric wire crimping part 12. The electric contact part 11 is a portion for connecting to a mate side male terminal (not shown). Such the connector terminal 1 may be used in such a manner that a portion between the electric contact part 11 and the electric wire crimping part 12 is bent substantially at right angles in the shape of L (see PTL 1). When the connector terminal 1 is attached to a housing, the connector terminal 1 may be bent so that the electric contact part 11 is extended in the direction of a Y axis shown in FIG. 4(*a*), namely, in the direction perpendicular to the bottom plate 12*a* of the electric wire crimping part 12 (see PTL 1).

When a bending work is carried out when the connector terminal is attached to the housing as described above, since the bending work is carried out in a separate step from a bending work in a manufacturing stage, there is possibility in that an imperfect attachment to the housing may possibly occur (for instance, the terminal is not fitted to a ferrite groove so that the terminal is deformed) due to the deterioration of a dimensional accuracy of a bending part and the bending work in the separate step causes a cost to be increased. Thus, the bending work of the connector terminal 1 is supposed to be carried out in the manufacturing stage, however, a stamping work of the connector terminal 1 is ordinarily carried out under a state that the bottom plate 12*a* of the electric wire crimping part 12 is connected to a belt shaped chain part and a plurality of connector terminals 1 are connected to the chain part. When the plurality of connector terminals 1 are connected to the chain part in such a way, if the electric contact part 11 is bent in the direction perpendicular to the bottom plate 12*a*, the electric contact part 11 does not exist on the same plane as the plane of the chain part and there is a high possibility in that a bending angle is changed. Accordingly, the belt shaped chain part cannot be inconveniently wound on a reel.

For making it possible to wind the belt shaped chain part on the reel, as shown in FIG. 5, a base material is supposed to be stamped so that a bent electric contact part 21 is arranged on the same plane (an X-Z plane) as a plane of a chain part 23 to which an electric wire crimping part 22 is connected like a connector terminal 2 shown in FIG. 4(*b*). In this case, since the electric contact part 21 is arranged on the same plane as the plane of the chain part, even when the chain part is wound on a reel, a bending angle is not changed.

CITATION LIST

Patent Literature

[PTL 1] JP-T-2003-527726

SUMMARY OF INVENTION

Technical Problem

However, in the usual connector terminal 2 shown in FIG. 4(*b*), when a gold plating having good contact performance is applied to the electric contact part 21 and a tin plating having low-cost characteristic and excellent soldering characteristic is applied to the electric wire crimping part 22, since a width WO of a material is limited, the ranges of the gold plating and the tin plating are occasionally overlapped on each other. Namely, FIG. 5 shows a state that a stamping work is carried out in a manufacturing step of the connector terminal 2 before a plating step and a bending work are carried out. A range W1 of the tin plating where the tin plating is applied to the electric wire crimping part 22 is overlapped by a width W3 on a range W2 of the gold plating where the gold plating is applied to the electric contact part 21 in a feeding direction parallel to the belt shaped chain part 23. When the range W1 of the tin plating is overlapped on the range W2 of the gold plating as described above, there is possibility in that the tin plating may adhere to the range of the gold plating and the contact performance of the gold plated part (the electric contact part 21) may be lowered due to a factor such as a corrosion of the tin plating. Accordingly, it is necessary that partial plating is carried out by masking or the gold plating is applied to both the electric contact part 21 and the electric wire crimping part 22, so that a production cost is increased.

Solution to Problem

The present invention is devised by considering the above-described problems and it is an object of the present invention to provide a connector terminal and a method for manufacturing a connector terminal which can apply a gold plating to an electric contact part and a tin plating to an electric wire crimping part without carrying out a partial plating by masking even when the bent electric contact part is arranged on the same plane as a plane of a chain part and can realize a low cost.

To achieve the above-described object, a connector terminal and a method for manufacturing a connector terminal according to the present invention are constructed as described below.

A first aspect of the present invention provides with a method for manufacturing a connector terminal in which an electric contact part to be connected to a mate side male terminal is bent substantially at right angles to an electric wire crimping part to be crimped and connected to a coated electric wire, the method comprising a stamping step of stamping from an electrically conductive metal plate a stamped terminal piece formed as the connector terminal under a state that the electric wire crimping part is connected to a belt shaped chain part and a plurality of stamped terminal pieces are connected to one side of the chain part, a gold plating step of applying a gold plating to the electric contact part, a tin plating step of applying a tin plating to the electric wire crimping part, and a bending step of forming the connector terminal by a bending work, wherein in the stamping step, the stamped terminal piece is stamped so that the electric wire crimping part is extended from the chain part in a direction that is perpendicular to a feeding direction in which the plurality of stamped terminal pieces are continuously arranged and the electric contact part is extended from the electric wire crimping part in a direction that is parallel to the feeding direction; and wherein a range to which the gold plating is applied by the gold plating step is not overlapped on a range to which the tin plating is applied by the tin plating step in the feeding direction.

A second aspect of the present invention provides with the method for manufacturing a connector terminal according to the first aspect of the invention, wherein the electric contact part includes a stage surface and a spring surface that presses the inserted mate side male terminal to the stage surface, in the stamping step, the spring surface and the stage surface are formed at positions more distant from the chain part than from the electric wire crimping part in the direction perpendicular to the feeding direction, and, in the gold plating step, the gold plating is applied to a range from the spring surface to the stage surface A third aspect of the present invention provides with a connector terminal manufactured by a method for manufacturing a connector terminal according to the first aspect or the second aspect.

Advantageous Effects of Invention

According to the present invention, when in the stamping step, when the stamped terminal piece formed as the connector terminal is stamped, the electric wire crimping part is stamped and extended from the chain part in the direction perpendicular to the feeding direction in which the plurality of stamped terminal pieces are continuously arranged, further, the electric contact part is stamped and extended from the electric wire crimping part in the direction parallel to the feeding direction and the range to which the gold plating is applied by the gold plating step is not overlapped on the range to which the tin plating is applied by the tin plating step in the feeding direction. Thus, the gold plating can be effectively applied to the electric contact part and the tin plating can be applied to the electric wire crimping part without carrying out the partial plating by masking and a low cost can be realized.

DESCRIPTION OF EMBODIMENTS

Now, a preferable exemplary embodiment of the present invention will be described by referring to the attached drawings.

Figure 1:
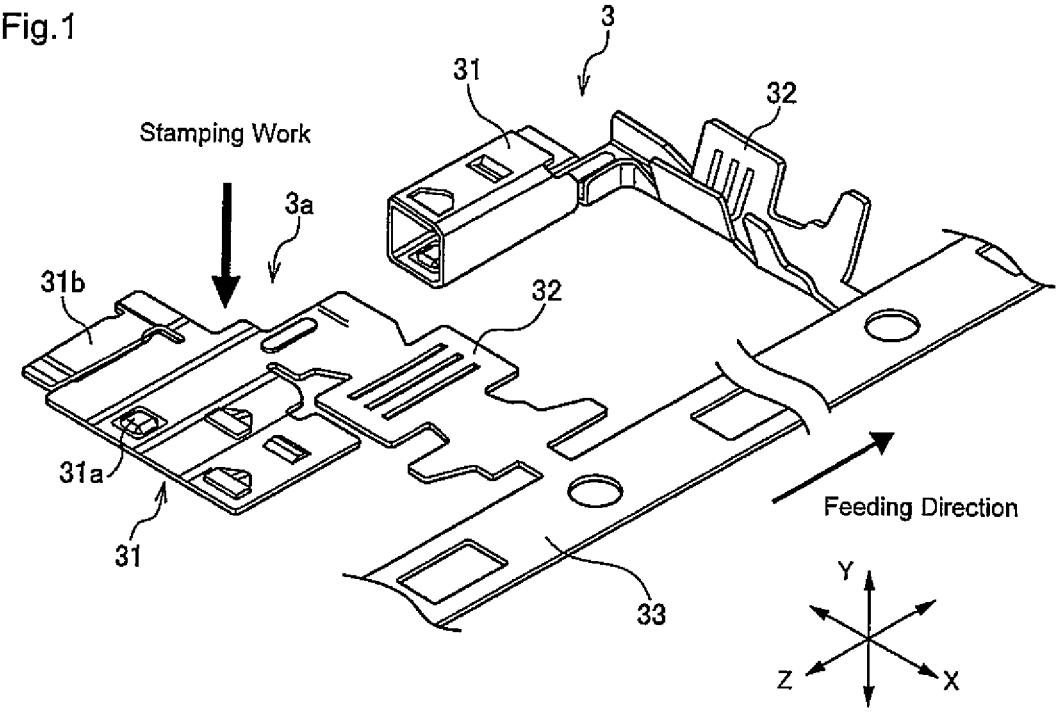
FIG. 1 is a perspective view for explaining a manufacturing step of an embodiment of a connector terminal according to the present invention.
Figure 2:
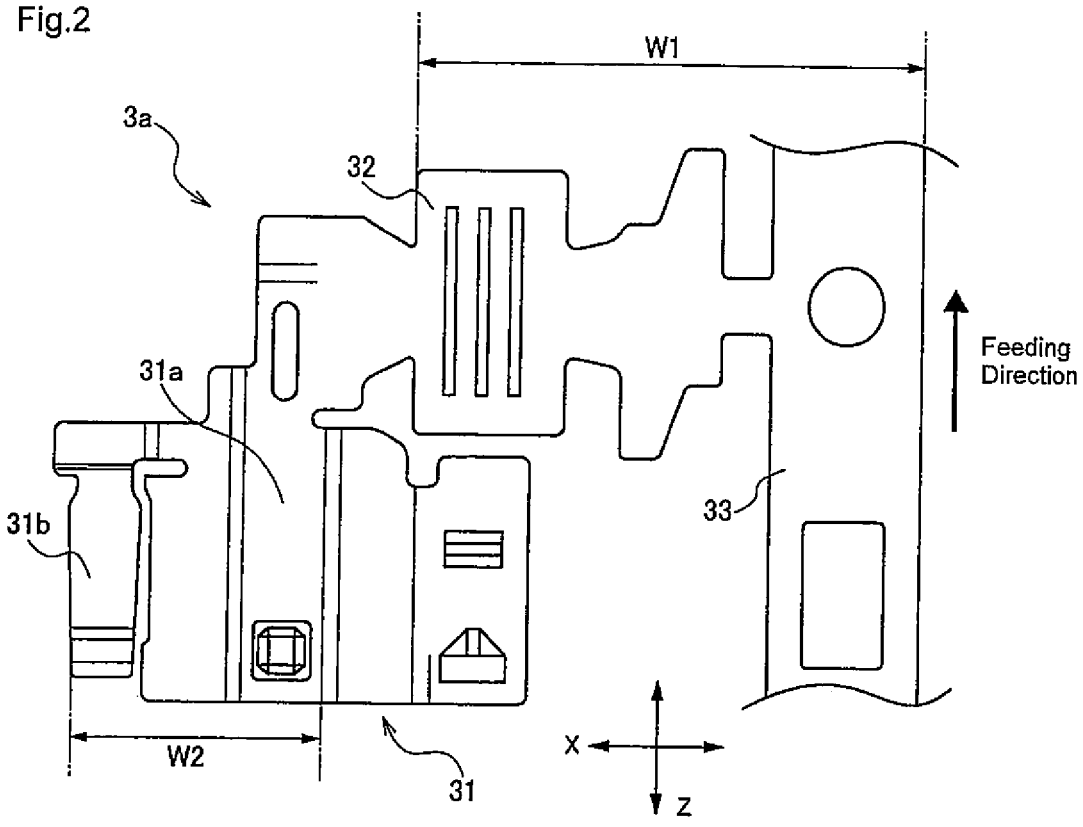
FIG. 2 is a plan view of an example of a stamped terminal piece shown in FIG. 1.

Referring to FIG. 1 and FIG. 2, in a method for manufacturing a connector terminal of the present exemplary embodiment, a connector terminal 3 is manufactured in which a tubular electric contact part 31 connected to a mate side male terminal is bent substantially at right angles to an electric wire crimping part 32 to which a coated electric wire is crimped and connected. In the manufacturing method, initially, a stamping step is carried out in which a stamped terminal piece 3*a* formed as the connector terminal 3 is stamped from a base material as an electrically conductive metal plate by a stamping work by a press.

In the stamped terminal piece 3*a*, the electric wire crimping part 32 side to which the coated electric wire is crimped and connected is connected to a chain part 33. A plurality of stamped terminal pieces 3*a* are stamped under a state that the stamped terminal pieces 3*a* are connected to one side of the chain part 33. Further, the chain part 33 is moved to a feeding direction (a direction of a Z-axis) shown by an arrow mark in FIG. 1 and FIG. 2, namely, to the direction in which the plurality of stamped terminal pieces 3*a* are continuously arranged, so that the stamped terminal piece 3*a* is conveyed to a subsequent step.

Referring to FIG. 2, in the stamped terminal piece 3*a*, the electric wire crimping part 32 is stamped and extended in the direction (a direction of an X-axis) that is perpendicular to the feeding direction from the chain part 33 and the electric contact part 31 is extended in an upstream side of the feeding direction (the direction of the Z-axis) from a distant opened end side of the electric wire crimping part 32 which is not connected to the chain part 33. When the stamped terminal piece 3*a* stamped in such a way is formed as the connector terminal 3, a coated electric wire that is not shown in the drawing is crimped and connected to the electric wire crimping part 32 in the direction (the direction of the X-axis) perpendicular to the feeding direction from the chain part 33. A mate side male terminal that is not shown in the drawing is connected to the electric contact part 31 from the upstream side of the feeding direction (the direction of the Z-axis).

On the stamped terminal piece 3*a*, in the electric contact part 31, at least a stage surface 31*a* and a spring surface 31*b* for pressing the inserted mate side male terminal to the stage surface 31*a* are stamped. The spring surface 31*b* is formed at the most distant position from the chain part 33 in the direction (the direction of the X-axis) perpendicular to the feeding direction. Further, in the direction (the direction of the X-axis) perpendicular to the feeding direction, the stage surface 31*a* is formed at a more distant position than the electric wire crimping part 32 from the chain part 33.

Then, for the stamped terminal piece 3*a*, a gold plating step is carried out for applying gold plating to the electric contact part 31. A range W2 to which the gold plating is applied is located within a range from the spring surface 31*b* of the electric contact part 31 the most distant from the chain part 33 to the stage surface 31*a* in the direction (the direction of the X-axis) perpendicular to the feeding direction. Since the stage surface 31*a* is more distant than the electric wire crimping part 32 from the chain part 33, the gold plating can be simply applied only to the range from the spring surface 31*b* to the stage surface 31*a* of the electric contact part 31 by a level control without masking the electric wire crimping part 32. Further, since the spring surface 31*b* and the stage surface 31*a* as a part that substantially comes into contact with the mate side male terminal are arranged from a direction distant from the chain part 33 in the direction (the direction of the X-axis) perpendicular to the feeding direction, even when the gold plating is applied by the level control, the gold plating is not applied to an entire part of the electric contact part 31 so that an area where the gold plating is applied may be reduced. Thus, a cost can be decreased.

Then, for the stamped terminal piece 3*a*, a tin plating step is carried out for applying tin plating to the electric wire crimping part 32. A range W1 to which the tin plating is applied is located within a range from the chain part 33 to the electric wire crimping part 32. Since the range W2 to which the gold plating is applied is more distant from the chain part 33 than from the electric wire crimping part 32, the tin plating can be simply applied to the range from the chain part 33 to the electric wire crimping part 32 by the level control without masking the range W2 to which the gold plating is applied.

As described above, the range W2 to which the gold plating is applied by the gold plating step is not overlapped on the range W1 to which the tin plating is applied by the tin plating step in the feeding direction. Thus, the plating steps can be respectively carried out without masking, so that the gold plating step and the tin plating step can be simplified.

Figure 3:
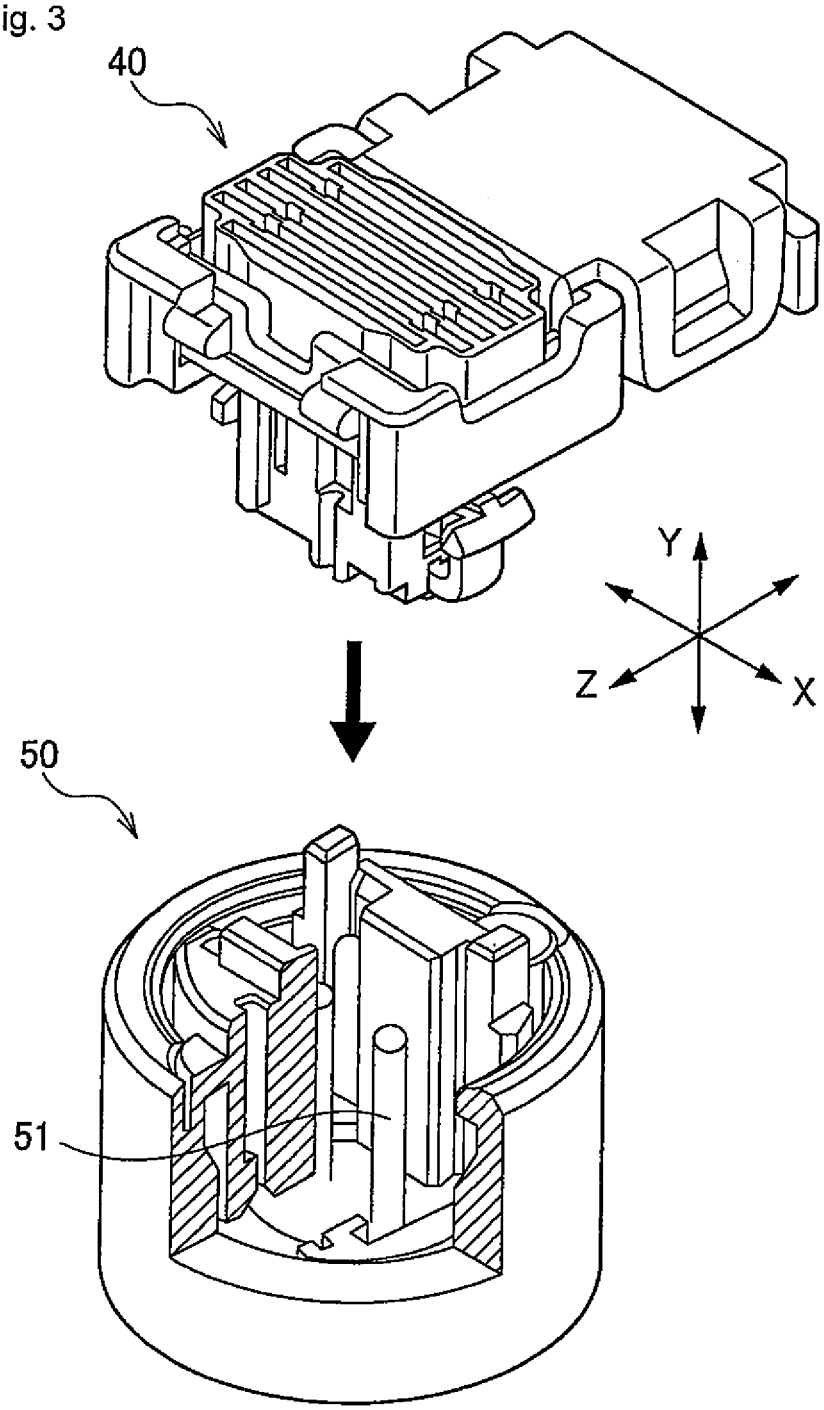
FIG. 3 is a perspective view for explaining a using example of the exemplary embodiment of the connector terminal according to the present invention.
Figure 4A:
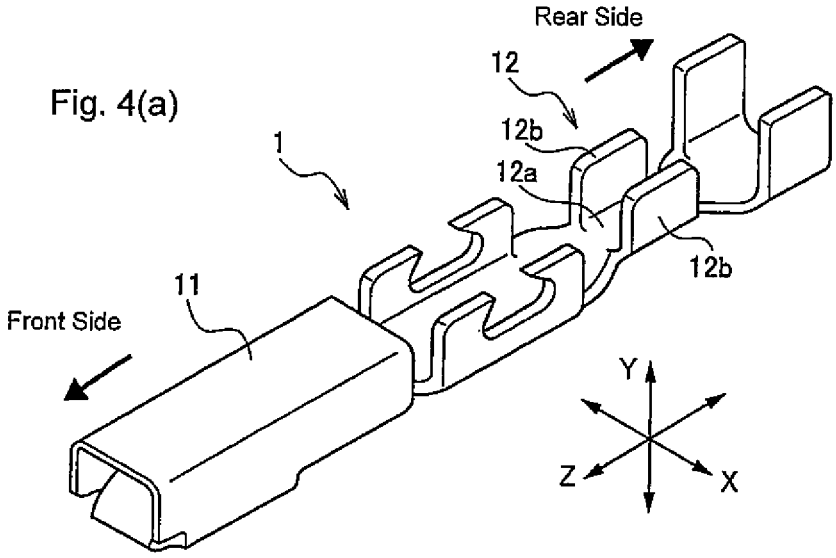
FIGS. 4 (*a*) and (*b*) are perspective views showing one example of a usual connector terminal.
Figure 4B:
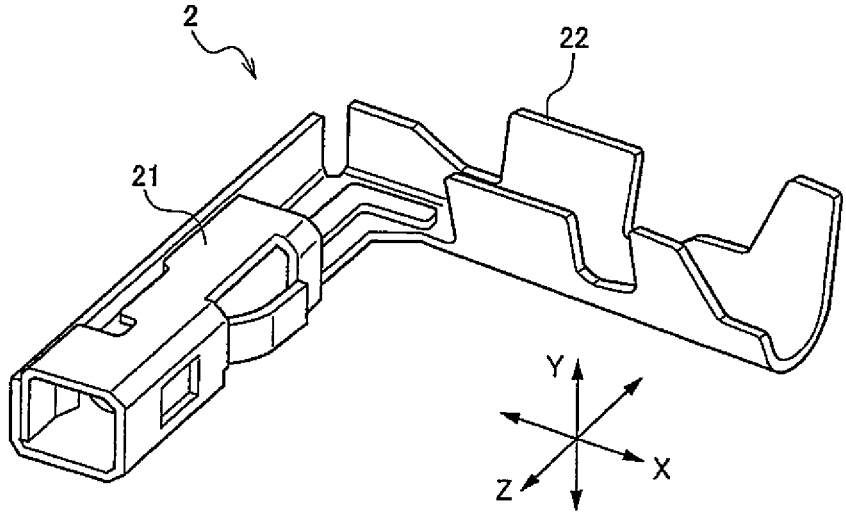
Figure 5:
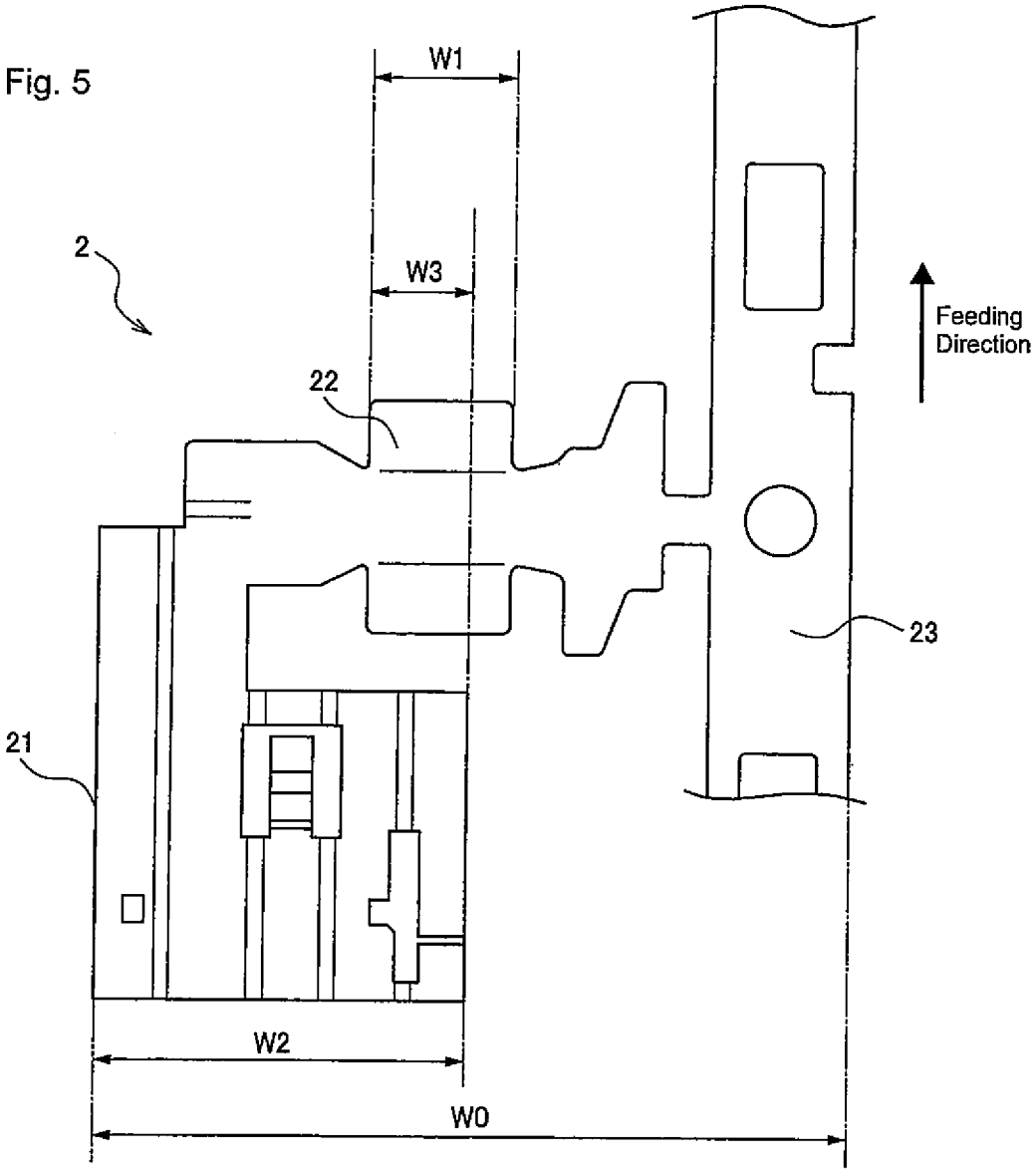
FIG. 5 is a plan view of a base material used in the usual connector terminal.

Then, a bending step is carried out for forming the connector terminal 3 by a bending work. Finally, when a connection of the chain part 33 to the electric wire crimping part 32 is cut, the connector terminal 3 is manufactured. The manufactured connector terminal 3 is attached to a harness side connector 40 as shown in FIG. 3 and used. In FIG. 3, the electric contact part 31 of the connector terminal 3 is arranged downward in the direction of a Y-axis and attached to the harness side connector 40. When the harness side connector 40 is fitted to a holder 50, a cylindrical mate side male terminal 51 provided in the holder 50 is inserted into the electric contact part 31 of the connector terminal 3 to obtain an electric connection.

The present invention is not limited to the above-described exemplary embodiment and it is to be understood that the exemplary embodiment may be suitably changed within a scope of a technical idea of the present invention. Further, the number, positions and forms of the components are not limited to those of the above-described exemplary embodiment and preferable number, positions and forms may be employed to embody the present invention. In the drawings respectively, the same components are designated by the same reference numerals.

This application is based upon and claims the benefit of priority of Japanese Patent Application No. 2010-203387 filed on Sep. 10, 2010, the contents of which are incorporated herein by reference.

INDUSTRIAL APPLICABILITY

According to the present invention, when in the stamping step, when the stamped terminal piece formed as the connector terminal is stamped, the electric wire crimping part is stamped and extended from the chain part in the direction perpendicular to the feeding direction in which the plurality of stamped terminal pieces are continuously arranged, further, the electric contact part is stamped and extended from the electric wire crimping part in the direction parallel to the feeding direction and the range to which the gold plating is applied by the gold plating step is not overlapped on the range to which the tin plating is applied by the tin plating step in the feeding direction. Thus, the gold plating can be effectively applied to the electric contact part and the tin plating can be applied to the electric wire crimping part without carrying out the partial plating by masking and a low cost can be realized.

REFERENCE SIGN LIST

1, 2, 3 connector terminal
3*a* stamped terminal piece
11, 21, 22 electric contact part
12, 22, 32 electric wire crimping part
23, 33 chain part
31*a* stage part
31*b* spring part
40 harness side connector
50 holder
51 mate side male terminal

The invention claimed is:

1. A method for manufacturing a connector terminal in which an electric contact part to be connected to a mate side male terminal is bent substantially at right angles to an electric wire crimping part to be crimped and connected to a coated electric wire, the method comprising:

a stamping step of stamping from an electrically conductive metal plate a stamping terminal mold formed as the connector terminal under a state that the electric wire crimping part is connected to a belt shaped chain part and a plurality of stamped terminal pieces are connected to one side of the chain part;

a gold plating step of applying a gold plating to the electric contact part;

a tin plating step of applying a tin plating to the electric wire crimping part; and a bending step of forming the connector terminal by a bending work;

wherein in the stamping step, the stamped terminal piece is stamped so that the electric wire crimping part is extended from the chain part in a direction that is perpendicular to a feeding direction in which the plurality of stamped terminal pieces are continuously arranged and the electric contact part is extended from the electric wire crimping part in a direction that is parallel to the feeding direction; and wherein a range to which the gold plating is applied by the gold plating step is not overlapped on a range to which the tin plating is applied by the tin plating step in the feeding direction.

2. The method for manufacturing a connector terminal according to claim 1, wherein the electric contact part includes a stage surface and a spring surface that presses the inserted mate side male terminal to the stage surface, in the stamping step, the spring surface and the stage surface are formed at positions more distant from the chain part than from the electric wire crimping part in the direction perpendicular to the feeding direction, and, in the gold plating step, the gold plating is applied to a range from the spring surface to the stage surface.

3. A connector terminal manufactured by a method for manufacturing a connector terminal according to claim 1.

* * * * *